United States Patent [19]

Hsu

[11] Patent Number: 4,822,246

[45] Date of Patent: Apr. 18, 1989

[54] FAN FOR MOVING FLUID AXIALLY AND RADIALLY

[76] Inventor: Yun-Tung Hsu, No. 9, Floor 2, Alley 2, Lane 437, Nei-Hu Rd., Sec. 1, Nei-Hu Dist., Taipei, Taiwan

[21] Appl. No.: 221,049

[22] Filed: Jul. 19, 1988

[51] Int. Cl.[4] ..... F04D 29/28

[52] U.S. Cl. ..... 416/175; 416/237

[58] Field of Search ..... 416/175 R, 170 C, 237 R, 416/237 A, 237 B

[56] References Cited

U.S. PATENT DOCUMENTS

| | | | |
|---|---|---|---|
| 752,275 | 2/1904 | Webber | 416/237 X |
| 866,292 | 9/1907 | Meston | 416/5 |
| 997,678 | 7/1911 | Jalonick | 416/170 C |
| 1,146,121 | 7/1915 | Amnelius | 416/237 |
| 1,413,296 | 4/1922 | Spreekmeester | 416/175 R X |
| 1,699,201 | 1/1929 | Guth | 416/237 X |
| 2,269,049 | 1/1942 | Zellweger | 416/175 R |
| 2,433,795 | 12/1947 | Stokes | 416/92 X |
| 2,650,755 | 9/1953 | Woodward | 416/186 R X |
| 3,328,005 | 6/1967 | McMaster et al. | 416/237 X |
| 4,061,441 | 12/1977 | Mejia | 416/175 R |

FOREIGN PATENT DOCUMENTS

| | | | |
|---|---|---|---|
| 2523180 | 2/1977 | Fed. Rep. of Germany | 416/175 |
| 14255 | of 1899 | United Kingdom | 416/237 R |
| 130983 | 2/1921 | United Kingdom | 416/237 R |
| 1414891 | 11/1975 | United Kingdom | 416/181 |

*Primary Examiner*—Everette A. Powell, Jr.

*Attorney, Agent, or Firm*—Oblon, Fisher, Spivak, McClelland & Maier

[57] ABSTRACT

A fan includes a plurality of circumferentially spaced blades fixed on an end of a motor shaft. Each of the blades includes a series of radially interconnected oblique planes which are all inclined circumferentially of the motor shaft in a direction so as to press or suck fluid when the motor shaft rotates. The outer one of any adjacent two of the oblique planes extends radially outwardly from the inner adjacent plane toward the other end of the motor shaft at an angle of less than 90 degrees so that the blades are generally L-shaped. The outermost one of the oblique planes of each of the blades is generally parallel to the motor shaft. Thereby, fluid can be pressed or sucked axially and radially of the motor shaft to establish a generally semi-spherical fluid flow field.

6 Claims, 4 Drawing Sheets

FAN FOR MOVING FLUID AXIALLY AND RADIALLY

BACKGROUND OF THE INVENTION

This invention relates to a fan, more particularly to one which has radially interconnected oblique planes so as to establish a semi-spherical fluid flow field.

Because a conventional fan blade consists of a single oblique plane which is normally twisted to form part of a helical surface, conventional fans can only create an air flow in the direction of the motor shaft axis. This axial air flow field is too small to meet the need of the user. For example, a ceiling fan can only blow air toward the area just below it. Also, an electrical exhaust fan can only suck air from the area just below it. It is preferable to increase the air flow range, however, from the standpoints of utility and economics.

SUMMARY OF THE INVENTION

It is therefore the main object of this invention to provide a fan which can move fluid axially and radially so as to establish a semi-spherical air flow field.

According to this invention, a fan includes a motor shaft, and a plurality of circumferentially spaced blades fixed on an end of the motor shaft. Each of the blades includes a series of radially interconnected oblique planes which are all inclined circumferentially of the motor shaft in a direction which allows them to press or suck fluid when the motor shaft rotates. The outer of any adjacent two of the oblique planes extends radially outwardly from the adjacent inner plane toward the other end of the motor shaft at an angle of less than 90 degrees so that the blades are generally L-shaped. The outermost of the oblique planes of each of the blades is generally parallel to the motor shaft. Thereby, fluid can be pressed or sucked axially and radially of the motor shaft. Each of the oblique planes is inclined circumferentially of the motor shaft at an angle of attack of between 10 and 40 degrees so as to effectively press or suck fluid.

Preferably, each of the blades includes a rib extending outward from a trailing edge thereof at a right angle for collecting fluid on the blade. And, each of the blades includes a plurality of triangular plates each extending outward from the junction between any adjacent two of the oblique planes at a right angle for guiding the flow of fluid.

BRIEF DESCRIPTION OF THE DRAWINGS

Other features and advantages of this invention will become apparent in the following detailed description of the preferred embodiments of this invention with reference to the accompanying drawings in which.

DETAILED DESCRIPTION OF THE PREFERRED EMBODIMENTS

Figure 1:
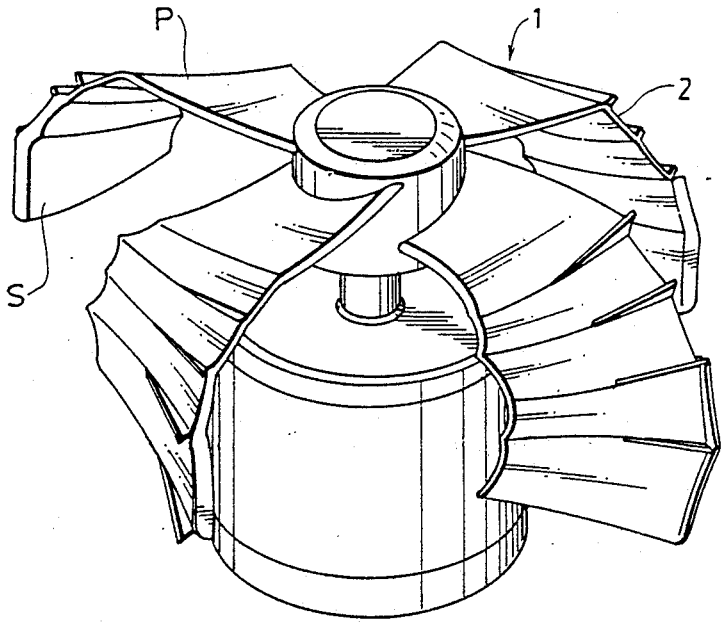
FIG. 1 is a perspective view of a fan according to a first embodiment of this invention.
Figure 2:
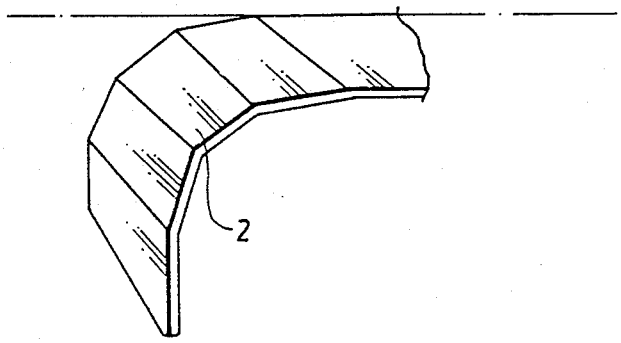
FIG. 2 is a schematic view illustrating the intersection angle between any adjacent two of the oblique planes of the blade of the fan according to this invention.
Figure 3:
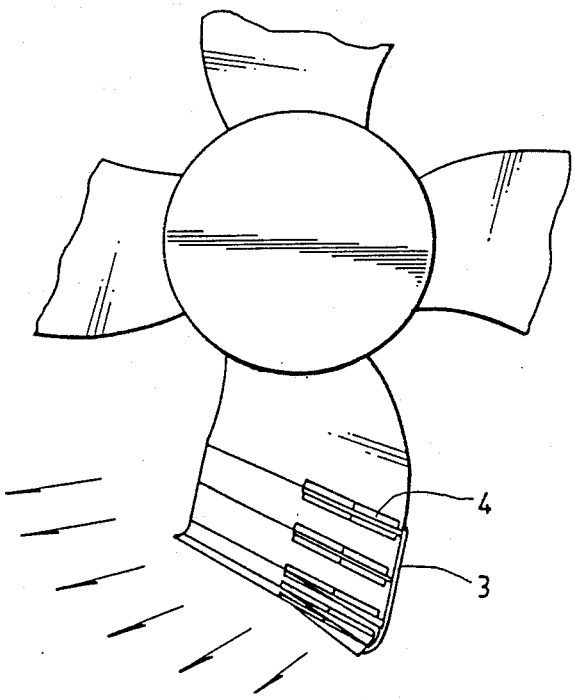
FIG. 3 is a schematic view illustrating the angle of attack of the oblique planes relative to the end surface of the motor shaft of the fan according to this invention.

Referring to FIG. 1, a fan of this invention has a motor shaft. The motor shaft is provided at an end thereof with four circumferentially spaced blades 1 each of which includes a series of radially obliquely interconnected oblique planes 2. Each of the blades 1 has a press side P and a suction side S. The outer of any adjacent two of the oblique planes 2 extends radially outwardly from the inner adjacent plane toward the other end of the motor shaft at an angle of less than 90 degrees so that the blades 1 are generally L-shaped. As illustrated, the outermost of the oblique planes 2 is generally parallel to the motor shaft. Referring to FIG. 3, each of the oblique planes 2 has an angle of attack of between 10 and 40 degrees relative to the end surface of the motor shaft so as to press air. Because an obtuse angle forms between any adjacent two of oblique planes 2 and an angle of attack of between 10 and 40 degrees forms between the oblique planes 2 and the end surface of the motor shaft, air can be pressed axially and radially of the motor shaft by the fan. A generally semi-spherical air flow field is therefore established. If necessary, the number of the blades 1 and the oblique planes 2 may be increased or reduced. When a strengthening of the air flow is desired, the angle of attack can be increased.

Figure 4:
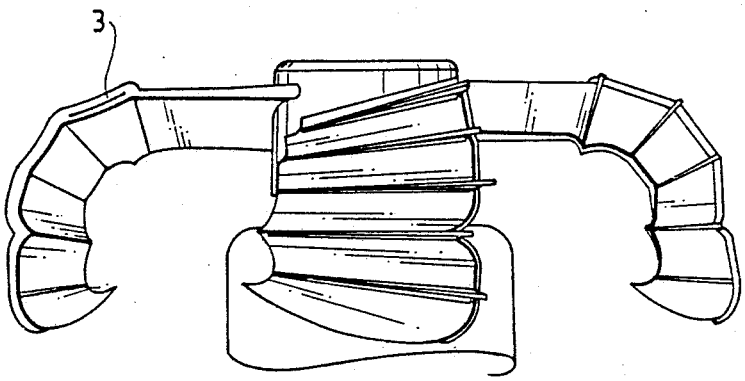
FIG. 4 is a schematic view illustrating the air collecting ribs of the fan according to this invention.

Referring to FIG. 4, each of the blades 1 includes an air collecting rib 3 extending outwardly from the trailing edge of the press side S thereof at a right angle so as to temporarily collect air on the blade 1. The greater the length of the rib 3, the more the quantity of the air collected on the blade 1. Therefore, the length of the rib 3 may be changed to that of FIGS. 1, 5 or 7 depending on the need of the user. Referring to FIG. 6, on the press side of the blade, a triangular plate 4' extends outward from the junction between any adjacent two of the oblique planes at a right angle for guiding air flow. The triangular plates 4' contact an air collecting rib 3'. If it is unnecessary to guide the air flow, the ribs 3' can be eliminated.

Figure 5:
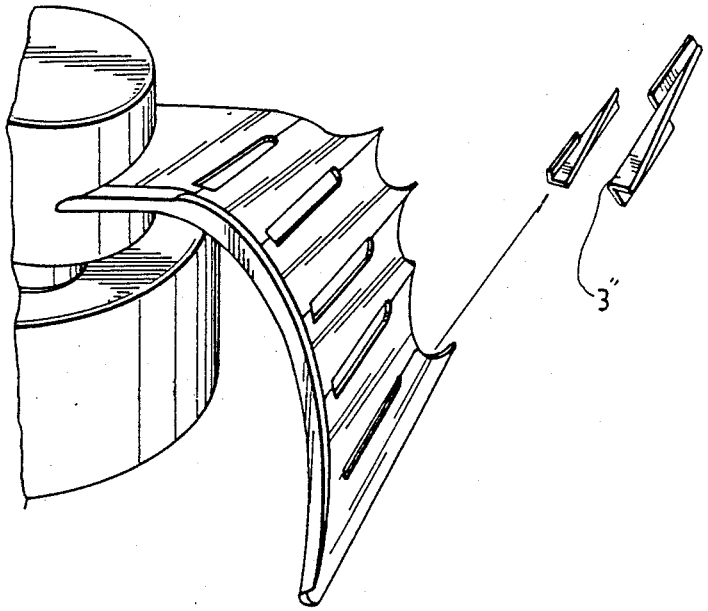
FIG. 5 is a schematic view illustrating a fan according to a second embodiment of this invention which has radially arcuated blades.
Figure 6:
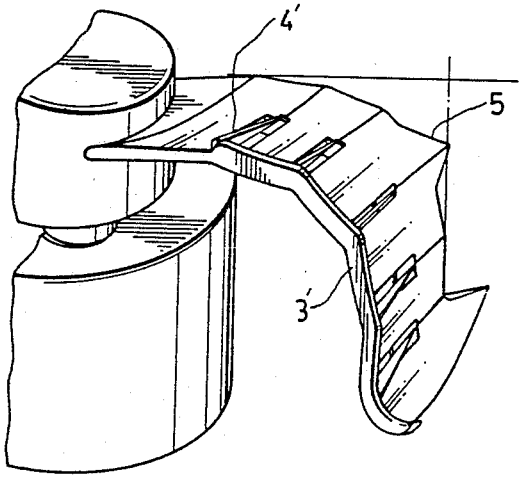
FIG. 6 is a schematic view illustrating the flow guiding triangular plates of the fan according to this invention.

The blade can be arcuated so that it is modified as shown in FIG. 5 allowing the establishment of a substantially semi-spherical air flow field. At this time, triangular plates 3" can be excluded.

Referring to FIG. 6, each of the blades preferably has a sharp leading edge 5 so as to reduce noise resulting from the friction between the leading edge 5 and the air.

Figure 7:
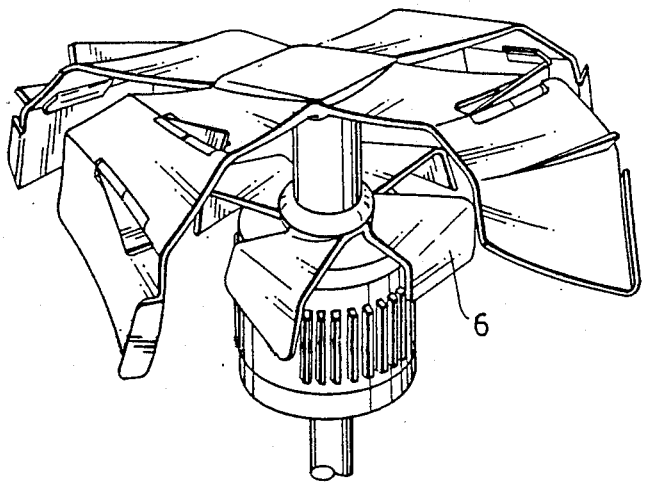
FIG. 7 is a schematic view illustrating a fan according to a third embodiment of this invention which serves as the propeller of a boat.

Referring to FIG. 7, another set of generally L-shaped small blades 6 may be mounted on an inner axial position of the motor shaft. The small blades 6 are similar to the blades 1 in construction except that their size is smaller. In this way, the radial thrust of air can be strengthened.

Figure 8:
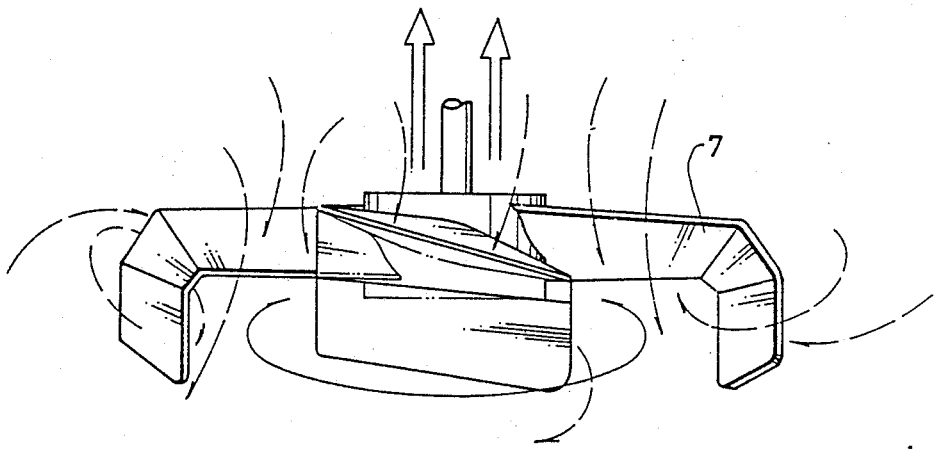
FIG. 8 is a perspective view showing a fan according to a fourth embodiment of this invention which has two set of blades of different radial lengths.

The fan of this invention is applicable to radiator fans for water tanks, radiator fans for baking systems, household electrical fans, ceiling fans, the cooling fans of air conditioning systems, exhaust fans, the cooling fans of refrigerators, the cooling fans of industrial heat dissipating systems, and the propellers of boats. When the fan of this invention is used as a radiator fan for discharging heat from the water tank of the engine of an automobile, it also simultaneously discharges hot air from the engine. Referring to FIG. 8, when it is used as the propeller 7 of a boat, the propelled water flow field is increased so that the advancing speed of the boat can be largely increased.

With this invention thus explained, it is apparent that numerous modifications and variations can be made without departing from the scope and spirit of this invention. It is therefore intended that this invention be limited only as indicated in the appended claims.

I claim:

1. A fan including a motor shaft, and a plurality of circumferentially spaced first blades fixed on a first axial position of an end of said motor shaft, characterized in that each of said first blades includes a series of radially interconnected oblique planes which are all inclined circumferentially of said motor shaft in a direction which allows them to press or suck fluid when said motor shaft rotates, outer one of any adjacent two of said oblique planes extending radially outwardly from said inner adjacent plane toward the other end of said motor shaft at an angle of less than 90 degrees so that said first blades are generally L-shaped, outermost one of said oblique planes of each of said first blades being generally parallel to said motor shaft, whereby, fluid can be pressed or sucked axially and radially of said motor shaft.

2. A fan as claimed in claim 1, wherein each of said oblique planes is inclined circumferentially of said motor shaft at an angle of attack of between 10 and 40 degrees so as to effectively press or suck fluid.

3. A fan as claimed in claim 1, wherein each of said first blades includes a rib extending outward from a trailing edge thereof at a right angle for collecting fluid on said first blade.

4. A fan as claimed in claim 1, wherein each of said first blades includes a plurality of triangular plates each extending outward from junction between any adjacent two of said oblique planes at a right angle for guiding flow of fluid.

5. A fan as claimed in claim 1, wherein said first blades extend radially arcuately from said motor shaft.

6. A fan as claimed in claim 1, wherein a set of generally L-shaped second blades are fixed on an inner axial position of said end of said motor shaft and of a radial length smaller than that of said first blades, said second blades also extending radially outwardly toward the other end of said motor shaft.

* * * * *